US011585600B2

(12) United States Patent
Yu

(10) Patent No.: US 11,585,600 B2
(45) Date of Patent: Feb. 21, 2023

(54) SOFTGEL DRYING MACHINE

(71) Applicant: Xiongqing Yu, Diamond Bar, CA (US)

(72) Inventor: Xiongqing Yu, Diamond Bar, CA (US)

( * ) Notice: Subject to any disclaimer, the term of this patent is extended or adjusted under 35 U.S.C. 154(b) by 565 days.

(21) Appl. No.: 16/714,660

(22) Filed: Dec. 13, 2019

(65) Prior Publication Data

US 2020/0355432 A1 Nov. 12, 2020

(30) Foreign Application Priority Data

May 7, 2019 (CN) ..... 201920647613.2

(51) Int. Cl.

| | |
|---|---|
| ***F26B 11/02*** | (2006.01) |
| ***F26B 11/04*** | (2006.01) |
| ***F26B 21/04*** | (2006.01) |
| ***F26B 21/08*** | (2006.01) |
| ***A61J 3/07*** | (2006.01) |

(52) U.S. Cl.

CPC ..... *F26B 11/028* (2013.01); *F26B 11/0445* (2013.01); *F26B 21/04* (2013.01); *F26B 21/086* (2013.01); *A61J 3/07* (2013.01)

(58) Field of Classification Search

CPC .... F26B 11/028; F26B 11/0445; F26B 21/04; F26B 21/086; F26B 11/04; F26B 21/083; A61J 3/07

See application file for complete search history.

(56) References Cited

U.S. PATENT DOCUMENTS

| | | | | |
|---|---|---|---|---|
| 9,470,441 | B2 * | 10/2016 | Takubo | B01D 53/265 |
| 2007/0214679 | A1 * | 9/2007 | Brandt, Jr. | A21C 15/00 34/611 |
| 2014/0345157 | A1 * | 11/2014 | Puckett | F26B 5/00 34/127 |

* cited by examiner

*Primary Examiner* — Jessica Yuen

(74) *Attorney, Agent, or Firm* — Tommy S F Wang; Wang IP Law Group, P.C.

(57) ABSTRACT

The softgel drying machine comprises a casing, an air channel, a drying chamber, an air return channel, a tumbler and an air-drying system. The casing comprises an air circulation chamber and an air generation chamber. The drying chamber comprises at least one air supply opening and at least one air returning plate. The air-drying system comprises at least one air blower fan, a dehumidification module and an air return cooling module. The air blower fan comprises an air blower inlet port, an air blower outlet port, a chiller and an air supply duct. The chiller is coupled to the air blower outlet port. The air return cooling module comprises an air return duct, an air return inlet port and an air return outlet port. The air return inlet port is airtightly coupled to the air return channel through the air return duct.

20 Claims, 5 Drawing Sheets

SOFTGEL DRYING MACHINE

CROSS-REFERENCE TO RELATED APPLICATION

This application claims priority benefit from China Patent Application No. 201920647613.2, filed on May 8, 2019 in the State Intellectual Property Office of the P.R.C, the disclosure of which is incorporated herein by reference in its entirety.

TECHNICAL FIELD OF THE INVENTION

The present application is related to the field of drying machine, and more specifically, to softgel drying machine.

BACKGROUND OF THE INVENTION

When making a softgel capsule (also referred to as "softgel"), the drying process has been a big challenge. During the drying process, the softgel needs to be rotated (tumbled) so the softgel surface are evenly expose while high velocity air flow continuously circulating inside the drying chamber so that the softgel won't split and retain the desire aesthetic shape. The air temperature while drying also must be control so that the sofngel can cure and stabilize. However, the above conditions cannot easily be achieved. Sofigel manufacture(s) had invested lot of resources to build their facility to suffice these conditions to dry softgel. Currently, there are two conventional methods of drying softgel; tray drying and continuous drying.

Tray Drying—the softgel come out of the tumble air-drying systems and are placed on drying trays. The trays are then stacked on dollies and pushed into drying tunnels/rooms under a controlled environment. These controlled tunnel/rooms require a dehumidifier system to supplied control air to a large room where trays of softgel are reserved. The cost is very high to design, built and operated. In addition, tray-drying take ups lots of time because the softgels need to be cure in these control room for days to achieve the desired softgel hardness.

Continuous Drying—Continuous drying uses more and larger tumble air-drying systems, the softgels spend more time in the air-drying systems. The hardness of the softgel is achieve when unload form series of tumble units. The current continuous drying, however, still require the use of a humidifier system. Thus, this process still very costly to build and operated as well.

In addition, currently majority of the manufactures dry their softgels in a condition room. However, the condition in these room are very difficult to maintain since staff frequently have to access the room to attend the softgels. Hence, unwanted draft wind enters the room when staff enter and/or exist, causing the room condition to fluctuate quite a bit and efficiency of drying the softgel is very poor.

Therefore, a need remains for a softgel drying machine to dry the softgel that generate high velocity re-circulating inside drying chamber with capability of controlling tumbling time, temperature and relative humidity.

SUMMARY OF THE INVENTION

The present application discloses a softgel drying machine to dry the softgel that generate high velocity re-circulating inside drying chamber with capability of controlling tumbling time, temperature and relative humidity.

The soft gel drying machine comprises a casing, an air channel, at least one drying chamber, an air return channel, at least one tumbler and an air-drying system.

The casing comprises an air circulation chamber and an air generation chamber.

The drying chamber is located at the air circulation chamber, and comprises at least one air supply opening and at least one air returning plate. The air supply opening is connected with the air channel for supplying cold air to the drying chamber. The air returning plate comprises at least one opening.

The air return channel is used for drawing air from the drying chamber.

The tumbler is located at the at least one drying chamber.

The air-drying system is located at the air generation chamber and comprises at least one air blower fan, a dehumidification module and an air return cooling module. The air blower fan comprises an air blower inlet port, an air blower outlet port, a chiller and an air supply duct. The chiller is coupled to the air blower outlet port. The air blower outlet port is airtightly coupled to the air channel through the air supply duct. The dehumidification module comprises a dehumidifier port and a dehumidifier vent. The air return cooling module comprises an air return duct, an air return inlet port and an air return outlet port. The air return inlet port is airtightly coupled to the air return channel through the air return duct. The air return outlet port is coupled to the dehumidifier port. The air blower inlet port is coupled to the dehumidification module.

In various exemplary embodiments, the softgel drying machine further comprises an airtight partition disposed between the air circulation chamber and the air generation chamber. The airtight partition comprises through holes for coupling the air supply duct and the air return duct.

In various exemplary embodiments, the softgel drying machine further comprises an air chiller system disposed at the drying generation chamber and coupled to the air blower fan.

In various exemplary embodiments, a set of air blower fan and a set of air return cooling module are respectively disposed on each side of the air-drying system. The air blower fan and the air return cooling module at the two sides are axisymmetric.

In various exemplary embodiments, wherein the air-drying system further comprises an air blower motor coupled to the air blower fan.

In various exemplary embodiments, wherein the dehumidification module further comprises a desiccant wheel filled with a desiccant, the desiccant wheel is coupled to the air return outlet port.

In various exemplary embodiments, wherein the air-drying system further comprises a heater module, the heater module comprises a heater element and a heater duct, the dehumidification module is coupled to the heater duct. The dehumidification module further comprises a sealing partition located between the desiccant wheel and the heater module. The sealing partition comprises an opening having the same shape as the desiccant wheel.

In various exemplary embodiments, wherein the air-drying system further comprises a heater module, the heater module comprises a heater element and a heater duct, the dehumidification module is coupled to the heater duct. The heater duct comprises at least one hole.

In various exemplary embodiments, wherein the air return cooling module further comprises an electrostatic filter disposed between the air return inlet port and the air return outlet port. The electrostatic filter filters oil and gas and eliminates electrostatic contained in the return air.

In various exemplary embodiments, wherein the air return cooling module further comprises a cooling section located between the air return outlet port and the air return inlet port. The air return cooling module further comprises a condenser coupled to the cooling section. The condenser cools the return air.

In various exemplary embodiments, wherein the air-drying system further comprises a refrigerating section disposed between the dehumidification module and the air blower fan.

In various exemplary embodiments, wherein the softgel drying machine comprises two drying chambers at the air circulation chamber. The softgel drying machine comprises two tumblers. One of the tumblers is located at one of the drying chambers correspondingly.

Based on the above, the softgel drying machine of the present application comprises of a chiller installed at the air blower fan, cooling the softgel without utilizing another external cooling device. As such, the temperature will not drastically fluctuate the cooling air is directly conveying into the drying chamber.

In addition, the set of air blower fan and the set of air return cooling module allow the softgel drying machine provide regenerative air to the second chambers. Furthermore, the cooling section and the condenser of the air return cooling module and the refrigerating section of the air-drying system may further increase the cooling capability of the softgel drying machine.

Simply put, the condition in the dry chamber will not drastically fluctuate since the air is only regenerated only in the drying chamber (smaller space compare to conditioning a whole spacious room). As such, the temperature, relative humidity in the chamber can be monitor and adjust.

Numerous other advantages and features of the present application will become readily apparent from the following detailed description of disclosed embodiments, from the claims and from the accompanying drawings.

BRIEF DESCRIPTION OF THE DRAWINGS

The objects, features and advantages of the present application will be more readily comprehensive upon referencing to the following disclosure when considering in conjunction with the accompany drawings, wherein like reference numerals are used to identify identical components in the various views, and wherein reference numerals with alphabetic characters are utilized to identify additional types, instantiations or variations of a selected component embodiment in the various views, in which.

DETAILED DESCRIPTION OF DISCLOSED EMBODIMENTS

Figure 1:
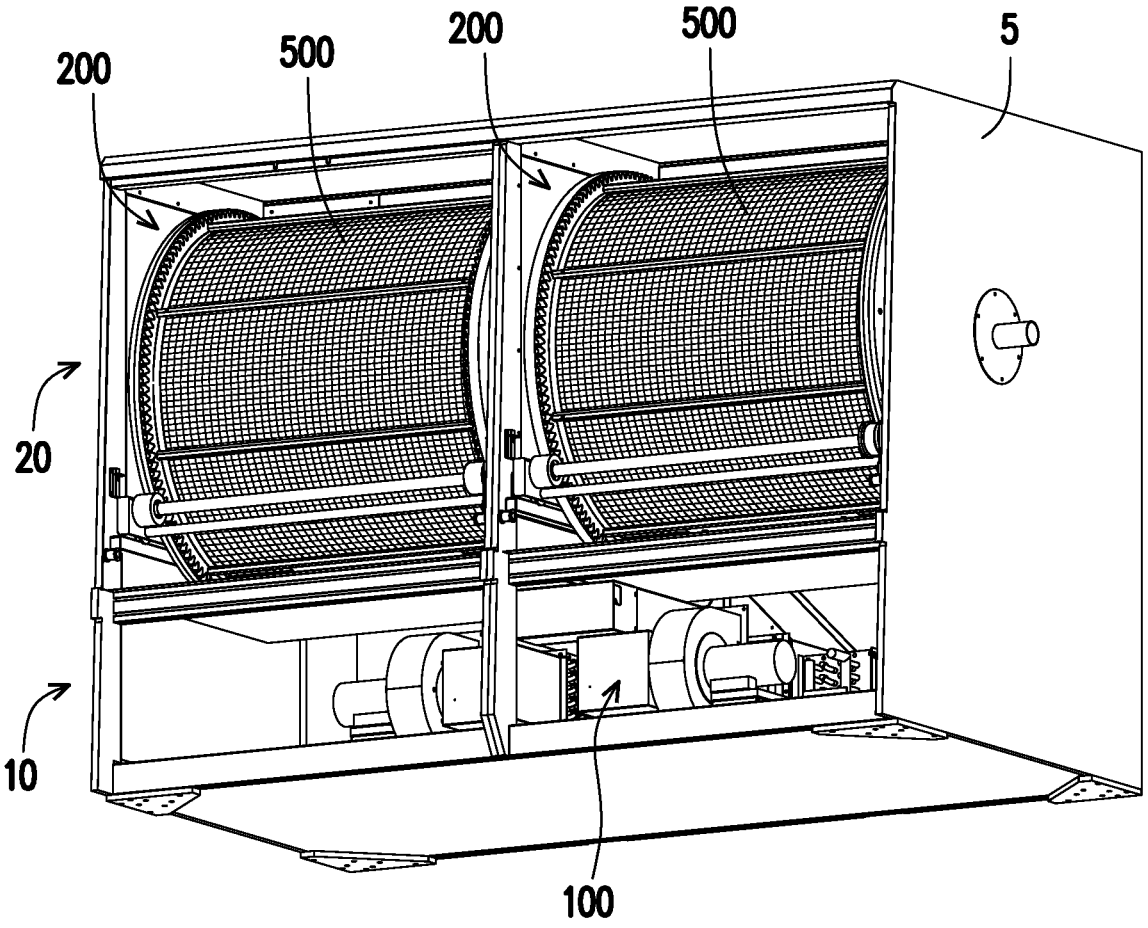
FIG. 1 is a view showing a softgel drying machine of the present application with one side of a casing is removed.

Reference will now be made in detail to the present representative embodiments of the present application, examples of which are illustrated in the accompanying drawings. Wherever possible, the same reference numbers are used in the drawings and the description to refer to the same or like parts.

Figure 2:
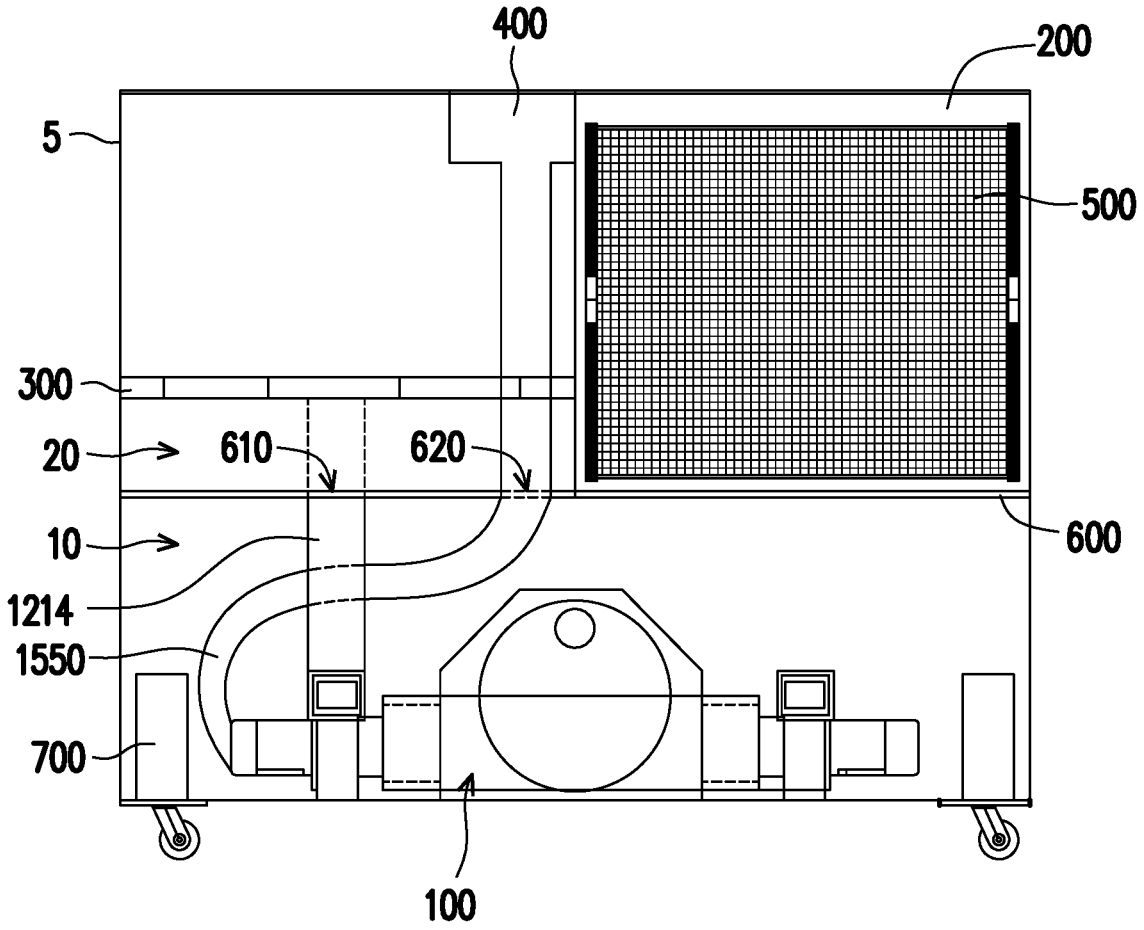
FIG. 2 is a view showing the softgel drying machine of the present application with one side of the casing and one tumbler are removed.
Figure 3:
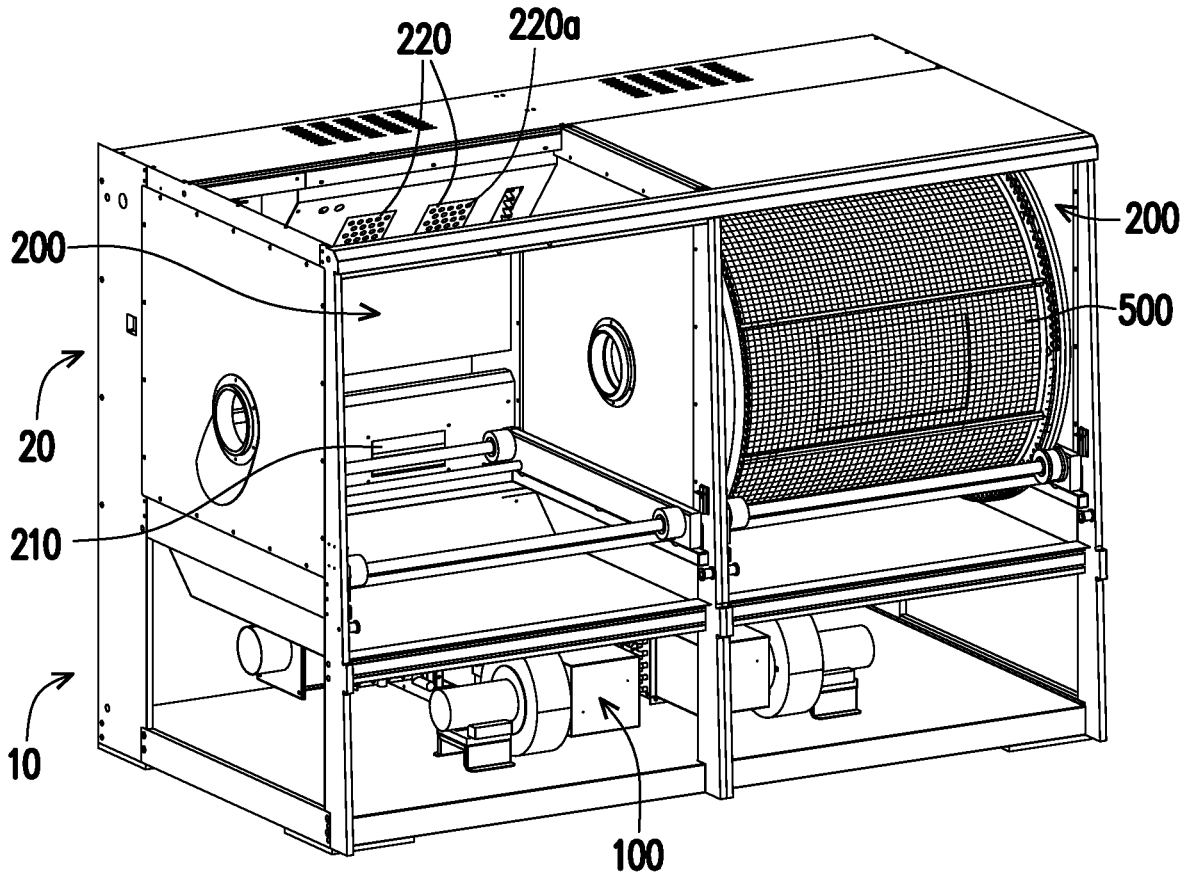
FIG. 3 is a view showing the softgel drying machine of the present application with part of the casing and one tumbler are removed.

FIG. 1 is a view showing a softgel drying machine of the present application with one side of a casing 5 is removed. FIG. 2 is a view showing the softgel drying machine of the present application with one side of the casing 5 and one tumbler 500 are removed. FIG. 3 is a view showing the softgel drying machine of the present application with part of the casing 5 and one tumbler 500 are removed.

Referring to FIGS. 1-3, the softgel drying machine of the present application comprises a casing 5, an air-drying system 100, at least one drying chamber 200, an air channel 300, an air return channel 400, at least one tumbler 500, an airtight partition 600 and an air chiller system 700.

The casing 5 comprises an air generation chamber 10 and an air circulation chamber 20. It should be noted that the casing may be made of any material, such as transparent plastic, stainless steel, etc. A stainless-steel plate is used in the present application, which is convenient for additionally installing other members on the top to enrich the function of the drying device.

The air generation chamber 10 is disposed beneath the air circulation chamber 20. However, the present application is not limited thereto, the location of the air generation chamber 10 and the air circulation chamber 20 can be adjusted. In the present application, the air generation chamber 10 and the air circulation chamber 20 are distributed up and down. However, the air generation chamber 10 and the air circulation chamber 20 may also be disposed at the left and right sides according to the actual manufacture demands, as long as the softgels can be dried by controlling drying time, air temperature and relative humidity with high velocity chill air recirculating inside the air circulation chamber 20.

The details of the air generation chamber 10 will be described later with FIGS. 4-5.

At least one drying chamber 200 is located at the air circulation chamber 20. The softgel drying machine of the present application comprises two drying chambers 200 as an example but is not limited thereto. The softgel drying machine comprises a left drying chamber and a right drying chamber, wherein the left drying chamber and the right drying chamber are the same. For simplifying, the present application utilizes a reference number of 200 for both left drying chamber and right drying chamber. The drying chamber 200 comprises at least one air supply opening 210 and an air returning plate 220. The air supply opening 210 is capable of allowing the air into the drying chamber 200. The air returning plate 220 comprises at least one opening **220*a*** for allowing the air fan to supply air for the chamber.

The air channel 300 is utilized for supplying air to the drying chamber 200. In the present application, the air channel 300 is disposed on a lower side of the drying chamber 200, and the air return channel 400 is disposed on an upper side of the drying chamber 200. However, the present application is not limited in the location of the air channel 300 and the air return channel 400. The location of the air channel 300 and the air return channel 400 of the present application is arranged according to the location of the air generation chamber 10 and the air circulation chamber 20. As such, the location of the air channel 300 and the air return channel 400 can be changed according to different layout of other structures.

Referring the drying chamber 200. The air supply opening 210 is located at the bottom side of the drying chamber 200 for allowing the cold air to enter the drying chamber 200.

The air supply opening 210 is connected with the air channel 300 for supplying cold air to the drying chamber 200. The amount and shape of the air supply opening 210 is not limited in the present application as long as the enough of cold air can be passed into the drying chamber 200.

As such, the air flow path will be: 1) cold and dry air flows through the air channel 300 and air supply opening 210 from the air generation chamber 10; 2) cold and dry air is used when drying softgels; 3) an air blower fan 1200 (referring to FIG. 4) draws the air from the drying chamber 200 though the openings 220*a* of the air returning plate 220 and the air return channel 400; 5) the air is returned to the air generation chamber 10 for filtering, cooling, and drying; 6) cold and dry air passes through an air supply duct 1550 to reach the air channel 300; and 7) cold and dry air passes through the air supply opening 210 into the drying chamber 200.

Similarly, the location of the air supply opening 210 and the air returning plate 220 are not limited thereto. The location of the air supply opening 210 and the air returning plate 220 of the present application is arranged according to the location of the air channel 300 and the air return channel 400 correspondingly.

The tumbler 500 is used for holding the softgel, will rotate continuously during drying in one direction and will rotate in reverse rotation when unloading softgels. The softgel drying machine comprises a left tumbler and a right tumbler, wherein the left tumbler and the right tumbler are the same. For simplifying, the present application utilizes a reference number of 500 for both left tumbler and right tumbler. The tumbler 500 is made of stainless-steel mesh holding softgels to allow air movement to contact to cool and dry the softgel by process of convection. It should be noted that it is only shows as an example to dispose one tumbler 500 in one drying chamber 200 in the present application. Disposing one tumbler 500 in each drying chamber 200 is require for the unit to fully function. However, any number of tumblers 500 can be provided depending on the actual production demands, It should be noted that the tumbler 500 can be operated in any direction and rate in the drying chamber 200. In the present application, a variable speed drive is disposed to control the tumbler 500, allowing each tumbler 500 to rotate at different rate within the drying machine and even in reverse rotation, In the present application, there are two drying chambers 200 disposed for the softgel drying machine. Each drying chamber 200 is equipped with one mesh tumbler 500 to contain the softgel.

Initially, an air blower device conveyed the softgel into the first tumbler 500. Each tumbler 500 is driven by a motor and rotate constantly during each drying stage. When the softgel is ready to be unloaded, the tumbler 500 will rotate in reverse conveying the sofngel to the next tumbler 500 in the series. It should be noted that multiple units can be connected to each other for additional tumbler if need. In this case, each drying chamber 200 is connected to each own build-in air-drying system that continuously recirculate high velocity dried cold air inside the drying chamber 200 and the tumbler 500 to dry the softgel.

The airtight partition 600 is disposed between the air circulation chamber 20 and the air generation chamber 10. The airtight partition 600 comprises two through holes 610/620 for installing an air supply duct 1214 and an air return duct 1550. The detail of the air supply duct 1214 and the air return duct 1550 will be described later with the FIGS. 4-5. It should be noted that the airtight partition 600 can be of any type. In addition, airtight treatment is provided at the through holes 610/620 in order to improve the airtightness.

The air chiller system 700 will be described later with FIGS. 4-5.

Figure 4:
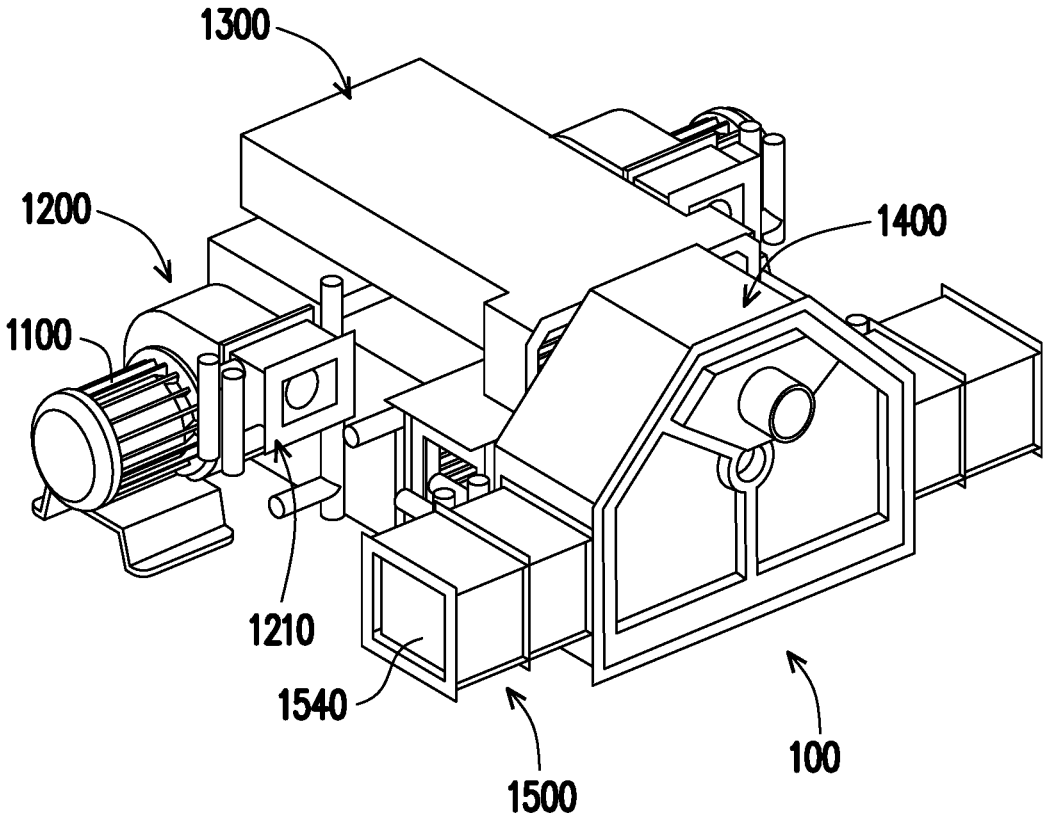
FIG. 4 is a view showing an air-drying system of the softgel drying machine of the present application.
Figure 5:
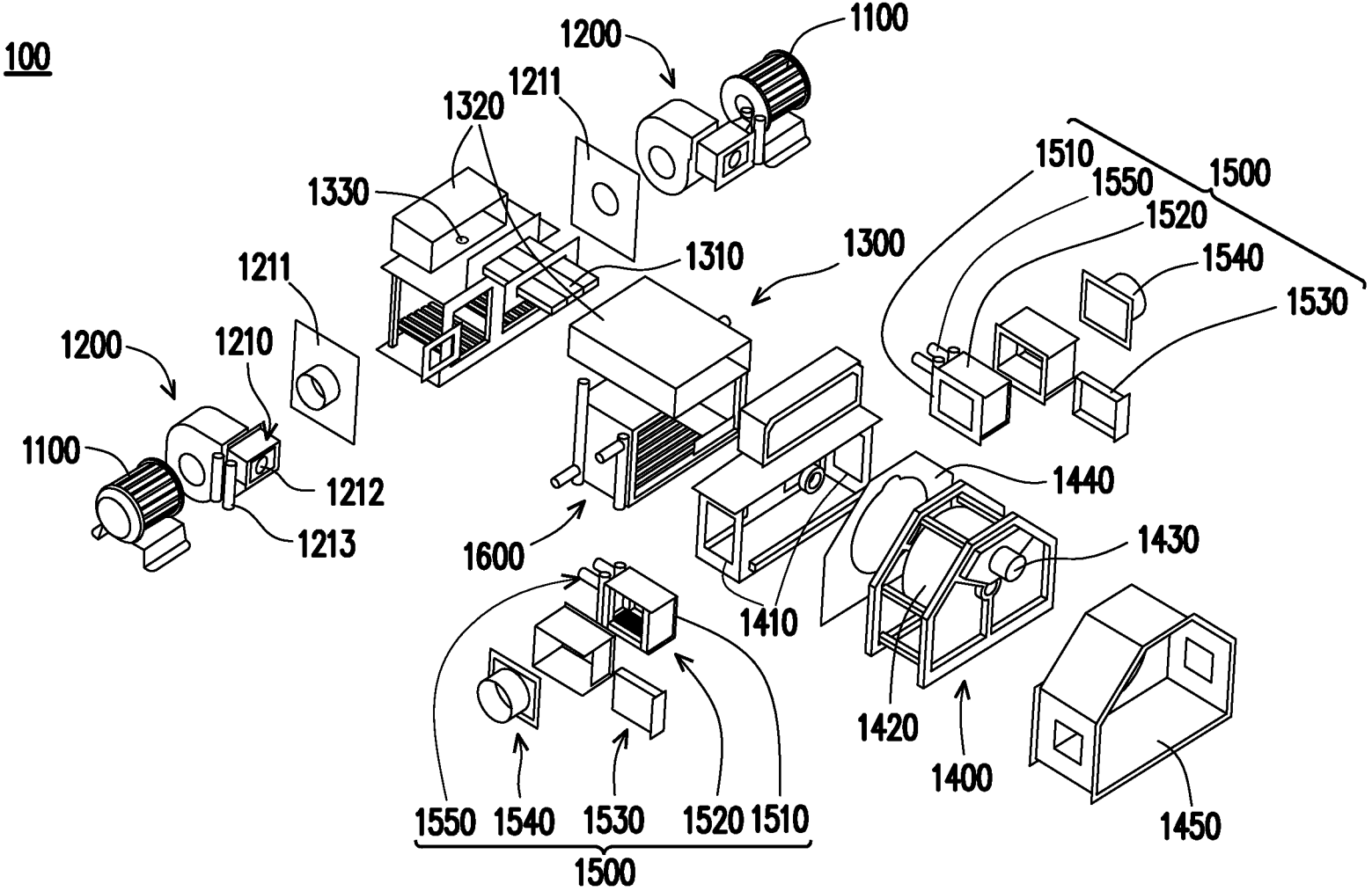
FIG. 5 is an exploded view showing the air-drying system of the softgel drying machine of the present application.

FIG. 4 is a view showing the air-drying system 100 of the softgel drying machine of the present application. FIG. 5 is an exploded view showing the air-drying system 100 of the softgel drying machine of the present application.

The air-drying system 100 is located at the air generation chamber 10. The air-drying system 100 comprises at least one air blower fan 1200, at least one air blower motor 1100, a dehumidifier system 1400, a heater module 1300, at least one air return cooling module 1500 and a refrigerating section 1600.

The air blower fan 1200 is driven by the air blower motor 1100.

In the present application, the air-drying system 100 comprises a set of air blower motor 1100, a set of air blower fan 1200, a set of air return cooling module 1500 as an example. For simplifying, the present application utilizes same reference numbers of 1100 for both air blower motor; 1200 for both air blower fan; and 1500 for both air return cooling module. Specifically, the set of air blower motor 1100, the set of air blower fan 1200 and air return cooling module 1500 are respectively disposed on each side of the air-drying system 100. In addition, the air blower motor 1100, the air blower fan 1200 and the air return cooling module 1500 at the two sides are axisymmetric. It should be noted that the axis symmetry is designed for disposing the two drying chambers 200 (referring to FIG. 3) in the present application. If a number of the drying chambers 200 are greater than 2, a corresponding number of the air blower motor 1100, the air blower fans 1200 and air return cooling modules 1500 can be disposed in the air-drying system 100 in an arbitrary distribution manner. Moreover, the set of air blower motor 1100, the set of air blower fan 1200 and the set of air return cooling module 1500 with sufficiently high power can also be combined as a single structure to uniformly supply air, as long as the cold air can be supplied to the air channel 300 (referring to FIG. 2).

The air blower motor 1100 is disposed for driving the air blower fan 1200. It should be noted that, since the air entering the air return cooling module 1500 (describe later) has a certain air speed, the air blower motor 1100 can continuously provide power. In fact, the air-drying system 100 can be operated without any air blower motor 1100 installed. Specifically, a set of rotation fan (not separately illustrated) may be installed behind the air supply plate 210 inside the air channel 300. The set of rotation fans can be used to increase the velocity of the supplying to the drying chamber 200.

The air blower fan 1200 comprises an chiller 1210, an air blower inlet port 1211, an air blower outlet port 1212, a refrigerating coil 1213 and the air supply duct 1214 (referring to FIG. 2).

The chiller 1210 is coupled to the air blower outlet port 1212 for refrigerating. It can be understood that refrigerating device of the present application is the chiller 1210 as an example only but is not limited. The chiller 1210 has the features of good refrigerating effect and fast speed. However, it can also be set into other forms of refrigerating device, such as a surface air cooler, or a condenser or the like, as long as the specific connection method can be adjusted accordingly. The air blower fan 1200 comprises a set of air blower inlet ports. For simplifying, the present application utilizes a reference number of 1211 for both air blower inlet ports.

With reference to FIG. 2, the air blower outlet port 1212 is airtightly coupled to the air channel 300 through the air supply duct 1214. It can be understood that the air supply duct 1214 can be any type of duct, such as a fixed duct installed in the casing, or a soft duct. In the present application, a soft duct is used to facilitate the duct arrangement.

The air chiller system 700 is disposed on a side close to the chiller 1210. The refrigerating coil 1213 is communicated with the air chiller system 700. It should be noted that the air chiller system 700 and the air-drying system 100 are separately disposed in the present application. However, the air chiller system 700 can be integrated into the air-drying system 100 for actual needs as long as the air blower fan 1200 can be modified accordingly. The air chiller system 700 comprises an evaporator coil (not separately illustrated) coupled to the air blower outlet port 1212 to cool the soft gel without utilizing another external cooling device.

FIGS. 1-2 show the case of two drying cavities 200. In this structure, the corresponding air-drying system 100 is provided with two air blower fans 1200 which are respectively connected to the air channel 300 through the air supply duct 1214. However, when a plurality of drying chambers 200 are provided in the actual production, a plurality of air blower fans 1200 can be disposed in the air-drying system 100, as long as one drying chamber 200 is corresponding to one air blower fan 1200.

The heater module 1300 is coupled to the dehumidification module 1400 and is utilized for generating hot air to vaporize the humidity of the dehumidification module 1400. The heater module 1300 comprises a heater element 1310, a heater duct 1320 and at least one hole 1330. The heater element 1310 help vaporize the humidity. The heater duct 1320 allowing the heat only to the top portion of the desiccant housing 1420 of the dehumidification module 1400. The heater housing is design with an open hole 1330 which is important for supplying make-up (aka as fresh air) air into the air-drying system 100.

The dehumidification module 1400 comprises at least one dehumidifier port 1410, a desiccant wheel 1420, a dehumidifier vent 1430, a sealing partition 1440 and a desiccant wheel housing 1450.

The dehumidifier port 1410 is coupled to the air return cooling module 1550. In the present application, the dehumidification module 1400 comprises two dehumidifier ports 1410 but is not limited thereto. The amount of the dehumidifier port 1410 can be adjusted according to the overall structure.

The desiccant wheel 1420 is filled with a desiccant. It should be noted that the desiccant in the desiccant wheel 1420 can be of any type, as long as cold air drying can be implemented. Active silica gel is used in the present application, which can provide better drying performance.

The dehumidifier vent 1430 is disposed at an upper side of the dehumidification module 1400. The humidity vaporized by the heater module 1300 is discharged by the dehumidifier vent 1430 to the outside of the softgel drying machine. The air blower inlet port 1210 is communicated with the dehumidifier vent 1420 of the dehumidification module 1400.

The sealing partition 1440 is located between the heater module 1300 and the desiccant wheel 1420. The sealing partition 1440 is provided with an opening having the same shape as the desiccant wheel 1420. It should be noted that the opening in the sealing partition 1440 may be of any shape, as long as the air circulation with the desiccant wheel 1420 can be realized.

The desiccant wheel housing 1450 covers the desiccant wheel 1420 for protection.

Each of the air return cooling module 1500 comprises an air return outlet port 1510, a cooling section 1520, an electrostatic filter 1530, an air return inlet port 1540 and the air return duct 1550 (referring to FIG. 2). For simplifying, in FIG. 5, the present application utilizes same reference numbers of 1510 for two air return outlet port; 1520 for two cooling section; 1530 for two electrostatic filter; 1540 for two air return inlet port; and 1550 for two air return duct.

The air return outlet port 1510 is communicated to a lower side of the dehumidification module 1400. Specifically, the air return outlet port 1510 is connected with the dehumidifier port 1410 of the dehumidification module 1400.

The cooling section 1520 is disposed with the air return outlet port 1510 for cooling the return air. It can be understood that the cooling section 1520 can be a cooling can use of any type of cooling system, such as an chiller, a condenser, etc., and can be adjusted according to actual production demands.

The electrostatic filter 1530 is utilized for filtering oil and gas and eliminates the electrostatic contained in the return air from re-entering into the return air stream. The electrostatic filter 1530 can be made of any material, as long as impurities such as oil, gas and electrostatic or particulate matter contained in the return air can be filtered.

Referring to FIG. 2, the air return inlet port 1540 is airtightly connected with the air return channel 400 through an air return duct 1550. It can be understood that the air return duct 1550 can be any type of duct, such as a fixed duct installed in the casing, or a soft duct. In the present application, the soft duct is used to facilitate the duct arrangement.

The refrigerating section 1600 is disposed between the desiccant wheel 1430 and the air blower fan 1200. The refrigerating section 1600 can be any type cooling system, such as an chiller, a condenser, etc., and can be adjusted according to actual production demands. The reason for installing another refrigerating section 1600 inside the air-drying system 100 is to cool down the air that is going to the drying chamber at the lower portion of the desiccant wheel module 1430. Generally inside the desiccant housing, the upper portion desiccant housing 1430 is heated using a heater module 1300 transfer the heat to vaporize the humidity of the dehumidifier module 1400; the cold air suppling to air circulation chamber 20 passing at lower portion of the desiccant housing also heat up. As such, the refrigerating section 1600 is added cool down the again.

Simply put, the air-drying system 100 of the present application comprises three stages of cooling sections: 1) the cooling sections 1520 of the air return cooling module 1500; 2) the refrigerating section 1600 and the dehumidifier system 1400; and 3) the chiller 1210 of the air blower fan 1200.

This drying machine can run in automatic mode or manual mode with a touch screen program logic control (PLC).

Based on the above, the softgel drying machine of the present application comprises an evaporator coil (not separately illustrated) of chiller system 1210 installed at the air blower outlet port 1212, cooling the softgel without utilizing another external cooling device. As such, the temperature will not drastically fluctuate the cooling air is directly conveying into the softgel drying chamber.

In addition, the set of air blower fan and the set of air return cooling module allow the softgel drying machine to have a pair of drying cavities, providing more output of the softgels. Furthermore, the refrigerating section of the air return cooling module and the refrigerating section of the air-drying system may further increase the cooling capability of the softgel drying machine.

It should be noted that each device is fixed by a quick connector, which is convenient for quick disassembly and maintenance in the present application. However, the present application is not limited thereto as long as the devices/modules can be assembled together.

It will be apparent to those skilled in the art that various modifications and variations can be made to the structure of the present application without departing from the scope or spirit of the present application. In view of the foregoing, it is intended that the present application cover modifications and variations of this application provided they fall within the scope of the following claims and their equivalents.

What is claimed is:

1. A softgel drying machine comprising:

a casing comprising an air circulation chamber and an air generation chamber;

an air channel;

at least one drying chamber located at the air circulation chamber, the drying chamber comprises:

at least one air supply opening connected with the air channel for supplying cold air to the drying chamber; and at least one air returning plate comprising at least one opening;

an air return channel for drawing air from the drying chamber;

at least one tumbler located at the at least one drying chamber; and an air-drying system located at the air generation chamber, comprising:

at least one air blower fan comprising an air blower inlet port, an air blower outlet port, a chiller and an air supply duct, the chiller is coupled to the air blower outlet port, the air blower outlet port is airtightly coupled to the air channel through the air supply duct;

a dehumidification module comprising a dehumidifier port and a dehumidifier vent; and an air return cooling module comprising an air return duct, an air return inlet port and an air return outlet port, wherein the air return inlet port is airtightly coupled to the air return channel through the air return duct, wherein the air return outlet port is coupled to the dehumidifier port, and the air blower inlet port is coupled to the dehumidification module.

2. The softgel drying machine as claimed in claim 1, further comprising an airtight partition disposed between the air circulation chamber and the air generation chamber, the airtight partition comprises through holes for coupling the air supply duct and the air return duct.

3. The softgel drying machine as claimed in claim 1, further comprising an air chiller system disposed at the air generation chamber and coupled to the air blower fan.

4. The softgel drying machine as claimed in claim 1, wherein a set of air blower fan and a set of air return cooling module are respectively disposed on each side of the air-drying system.

5. The softgel drying machine as claimed in claim 4, wherein the air blower fan and the air return cooling module at the two sides are axisymmetric.

6. The softgel drying machine as claimed in claim 1, wherein the air-drying system further comprises an air blower motor coupled to the air blower fan.

7. The softgel drying machine as claimed in claim 1, wherein the dehumidification module further comprises a desiccant wheel filled with a desiccant, the desiccant wheel is coupled to the air return outlet port.

8. The softgel drying machine as claimed in claim 1, wherein he air-drying system further comprises a heater module, the heater module comprises a heater element and a heater duct, the dehumidification module is coupled to the heater duct.

9. The softgel drying machine as claimed in claim 8, wherein the dehumidification module further comprises a sealing partition located between the desiccant wheel and the heater module.

10. The softgel drying machine as claimed in claim 9, wherein the sealing partition comprises an opening having the same shape as the desiccant wheel.

11. The softgel drying machine as claimed in claim 8, wherein the heater duct comprises at least one hole.

12. The softgel drying machine as claimed in claim 1, wherein the air return cooling module further comprises an electrostatic filter disposed between the air return inlet port and the air return outlet port.

13. The softgel drying machine as claimed in claim 12, wherein the electrostatic filter filters oil and gas and eliminates electrostatic contained in the return air.

14. The softgel drying machine as claimed in claim 1, wherein the air return cooling module further comprises a cooling section located between the air return outlet port and the air return inlet port.

15. The softgel drying machine as claimed in claim 14, wherein the air return cooling module further comprises a condenser coupled to the cooling section.

16. The softgel drying machine as claimed in claim 15, wherein the condenser cools the return air.

17. The softgel drying machine as claimed in claim 1, wherein the air-drying system further comprises a refrigerating section disposed between the dehumidification module and the air blower fan.

18. The softgel drying machine as claimed in claim 1, wherein the softgel drying machine comprises two drying chambers at the air circulation chamber.

19. The softgel drying machine as claimed in claim 18, wherein the softgel drying machine comprises two tumblers.

20. The softgel drying machine as claimed in claim 19, wherein one of the tumblers is located at one of the drying chambers correspondingly.

* * * * *